US006450844B1

(12) United States Patent
Mizumura et al.

(10) Patent No.: US 6,450,844 B1
(45) Date of Patent: Sep. 17, 2002

(54) SOCKET ASSEMBLY FOR A PIN GRID-ARRAY PACKAGE AND TERMINALS THEREFOR

(75) Inventors: Akinori Mizumura, Yamato; Masato Okano, Machida, both of (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/559,941

(22) Filed: Apr. 27, 2000

(30) Foreign Application Priority Data

Apr. 28, 1999 (JP) ..... 11-121051

(51) Int. Cl.[7] ..... H01R 9/24
(52) U.S. Cl. ..... 439/884; 439/342
(58) Field of Search ..... 439/342, 83, 884

(56) References Cited

U.S. PATENT DOCUMENTS

| | | | | |
|---|---|---|---|---|
| 5,299,950 A | | 4/1994 | Kaneko | 439/342 |
| 5,489,218 A | | 2/1996 | McHugh | 439/342 |
| 5,492,488 A | | 2/1996 | Hsu | 439/342 |
| 5,529,511 A | | 6/1996 | Matsuoka | 43/342 |
| 5,562,474 A | | 10/1996 | Lee | 439/342 |
| 5,597,320 A | | 1/1997 | Wang et al. | 439/342 |
| 5,692,920 A | | 12/1997 | Banakis et al. | 439/342 |
| 5,746,608 A | * | 5/1998 | Taylor | 439/70 |
| 5,791,929 A | | 8/1998 | Banakis et al. | 439/342 |
| 5,989,049 A | * | 11/1999 | Walkup et al. | 439/342 |
| 6,022,236 A | | 2/2000 | McHugh et al. | 439/342 |
| 6,056,576 A | | 5/2000 | Szu | 439/342 |
| 6,074,233 A | | 6/2000 | Lin | 439/342 |
| 6,086,401 A | | 7/2000 | Hsiung et al. | 439/342 |
| 6,095,842 A | | 8/2000 | Lin | 439/342 |
| 6,099,321 A | * | 8/2000 | McHugh et al. | 439/342 |
| 6,099,326 A | | 8/2000 | Lin | 439/83 |
| 6,113,411 A | | 9/2000 | Lu et al. | 439/342 |
| 6,113,412 A | | 9/2000 | Lin | 439/342 |
| 6,142,810 A | | 11/2000 | Hsiao et al. | 439/342 |
| 6,142,811 A | | 11/2000 | Lin | 439/342 |
| 6,152,757 A | | 11/2000 | Szu | 439/342 |
| 6,162,080 A | * | 12/2000 | Treibergs et al. | 439/268 |
| 6,165,001 A | | 12/2000 | Hsiao | 439/342 |
| 6,186,817 B1 | | 2/2001 | Szu | 439/342 |
| 6,210,196 B1 | | 4/2001 | Wang et al. | 439/342 |
| 6,210,198 B1 | | 4/2001 | McHugh et al. | 439/342 |
| 6,213,807 B1 | | 4/2001 | Huang et al. | 439/342 |
| 6,217,362 B1 | | 4/2001 | Pei et al. | 439/342 |

OTHER PUBLICATIONS

U.S. patent application Ser. No. 09/388,845, filed Sep. 2, 1999.

* cited by examiner

*Primary Examiner*—Tulsidas Patel
(74) *Attorney, Agent, or Firm*—Charles S. Cohen; Thomas D. Paulius

(57) ABSTRACT

A socket for a pin grid-array package includes a base housing having terminals arranged in the same grid pattern as the lead pins of the pin grid-array package, an overlying slide cover having through holes arranged in the same grid pattern for accommodating the lead pins, and a slide drive for driving the overlying slide cover on the underlying base housing. The base housing is designed so that terminals may be press-fit in their terminal-receiving cavities from above the upper side of the base housing until their tails to appear from the bottom of the base housing.

9 Claims, 12 Drawing Sheets

SOCKET ASSEMBLY FOR A PIN GRID-ARRAY PACKAGE AND TERMINALS THEREFOR

FIELD OF THE INVENTION

The present invention relates generally to an electrical connector and, more particularly, to a socket for connecting a pin grid-array ("PGA") package to a circuit member and terminals within the socket.

BACKGROUND OF THE INVENTION

A typical PGA package includes a silicon chip, a package including conductive and non-conductive components and a plurality of lead pins in a grid array depending downward from a bottom surface of the package. Conventionally, sockets for PGA packages include a plate-like base housing having a plurality of terminals arranged in the same grid pattern as the lead pins of the PGA package and a plate-like cover member having a plurality of through holes in the same grid pattern as the lead pins of the pin grid-array package, thus permitting the lead pins to be inserted in the through holes. The plate-like cover member is slidably positioned on the upper surface of the base housing. Some examples of such sockets are shown in Japanese Patent Application Laid-Open No. 7-142134 and Japanese Registered Utility Model No. 2-536440.

The base housing and cover are slidably interconnected so that the cover is driven in a plane parallel to the underlying base housing between a first position in which the lead pins of the PGA package can pass through the through holes of the cover to reach the terminals mounted in the underlying base housing without requiring any insertion force to be applied to the lead pins and a second position in which the lead pins of the PGA package contact the terminals.

A variety of terminal structures have been proposed as appropriate for use in such sockets. Some such terminals are configured such that their contact portions engage the lead pins of a PGA package upon movement of the cover of the socket, as shown in Japanese Patent Application Laid-Open No. 7-142134 and Japanese Registered Utility Model No. 2-536440 referred to above. Conversely, some terminals are configured such that the lead pins of a PGA package are brought to the contact portions of terminals in the base housing as shown in Japanese Patent Application Laid-Open Nos. 9-185981 and 9-204969.

Essentially all of the prior art terminals have contact portions located in the terminal-receiving cavities of the base housing of the socket, and most have straight pin-like solder tails extending from the bottom of the base housing of the socket. These pin-like solder tails are inserted into through holes of a printed circuit board on which the socket is mounted, and are soldered to the printed circuit board.

The base housing typically has some type of drive mechanism formed thereon for slidably moving the cover over the underlying base housing. In some sockets, a cam is rotatably attached to one lateral side or end of the base housing, and the cam is adapted to be rotated with an associated handle, thereby permitting the cam axle to push or pull the cover over the underlying base housing. The handle may be rotated from a horizontal position in which it is parallel to the base housing to a vertical position in which it is perpendicular to the base housing.

The demand for ever smaller electronic devices has driven the demand for smaller components that make up the electronic devices. However, customers also desire increasing performance from these smaller devices. Thus, component designers must continue to shrink their designs while still improving their performance and ease of use.

SUMMARY OF THE INVENTION

One object of the present invention is to provide a socket for a pin grid-array package, the parts of which socket are so designed that the socket can be produced at an increased efficiency.

To attain this object, a socket assembly for a pin grid-array package includes a plate-like base housing having a plurality of terminals arranged in the form of a grid and mounted therein for making electric connection to respective ones of lead pins of a pin grid-array package. A plate-like slide cover has a corresponding plurality of through holes therein for accommodating the lead pins and the plate-like cover is positioned on the upper surface of the base housing. A slide drive is provided to move the slide cover between a first position at which the lead pins can be inserted in the terminals of the base housing with zero insertion force after passing through the through holes of the cover and a second position at which the lead pins engage the terminals of the base housing. The terminal cavities in the base housing each include an upper opening in the upper surface of the base housing, and a lower hole in the bottom of the base housing. Each of the terminals is press-fit into a selected terminal cavity from above, allowing its soldering tail to pass through the lower hole so that the solder tail extends from the bottom of the base housing.

Each terminal may comprise a rectangular base, two opposing contact pieces integrally connected to the opposite longitudinal sides of the rectangular base and rising generally upright therefrom, and a "U"-shaped engagement piece integrally connected to one lateral side of the rectangular base via a first joint arm which extends upward. The opposing contact pieces and the "U"-shaped engagement piece may be equal in height, and equal to the depth of the terminal cavity, thus permitting the "U"-shaped engagement piece to be pushed against the surrounding wall of the base housing.

The terminal may further comprise a tail integrally connected to the rectangular base opposite the first joint arm via a second joint arm, which extends downward below the rectangular base. The lower hole is large enough to allow the tail to pass therethrough when the terminal is press-fit into the terminal cavity from above.

The terminals may also include two resilient detent projections or arms integrally connected to the other lateral side of the rectangular base, inclining upward from the opposite sides of the second joint arm, in which case each of the terminal cavities will have step-like indentations made in their inner walls to catch the opposite detent projections when a terminal is press-fit into the terminal cavity.

Another object of the present invention is to provide a terminal structure as described above that is appropriate for use in such a socket.

BRIEF DESCRIPTION OF THE DRAWINGS

Other objects and advantages of the present invention will be understood from the following description of a socket assembly and terminals therefor according to one preferred embodiment of the present invention which is shown in accompanying drawings.

DESCRIPTION OF THE PREFERRED EMBODIMENT

Referring to FIGS. 1 to 4, a socket assembly 50 for a pin grid-array package (not shown) includes a rectangular plate-like base housing 51 and a rectangular plate-like slide cover 52 lying thereon. The slide cover 52 has depending engagement pieces 53 formed on its opposite sides, and these engagement pieces 53 are applied to the opposite sides of the base housing 51 to permit the slide cover 52 to slide on the underlying base housing 51 in the left and right directions as viewed in FIG. 1.

Figure 5:
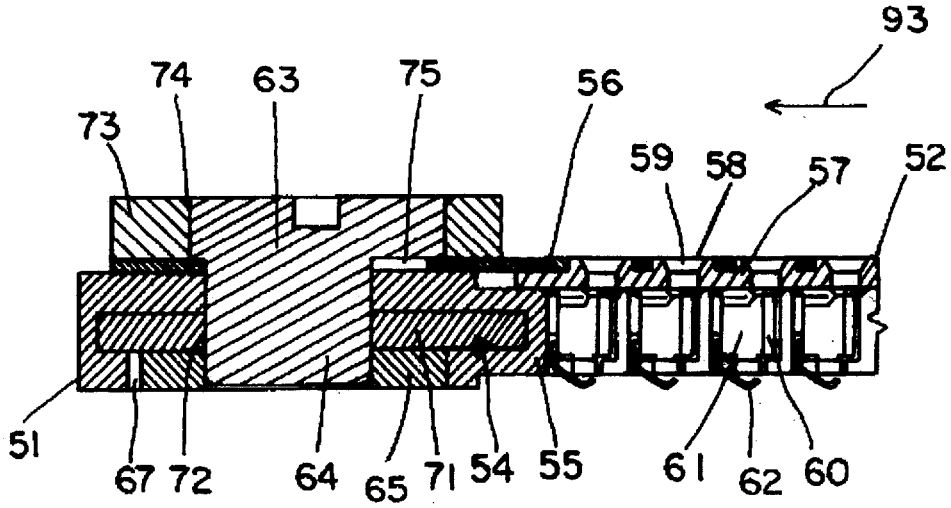
FIG. 5 is an enlarged sectional view of a selected portion of the socket assembly.
Figure 6:
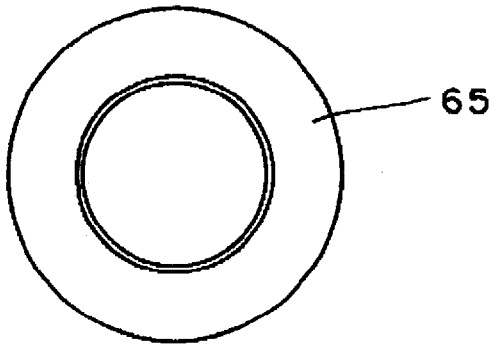
FIG. 6 is a top plan view of a fixing ring, which is subsequently attached to an eccentric cam axle of an eccentric cam member.
Figure 7:
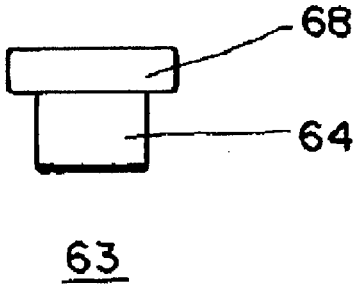
FIG. 7 is a front view of the eccentric cam member.
Figure 8:
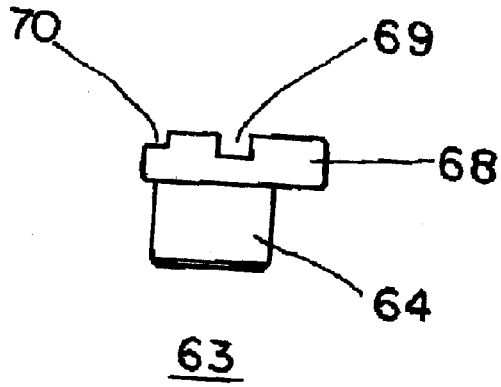
FIG. 8 is a left side view of the eccentric cam member.
Figure 9:
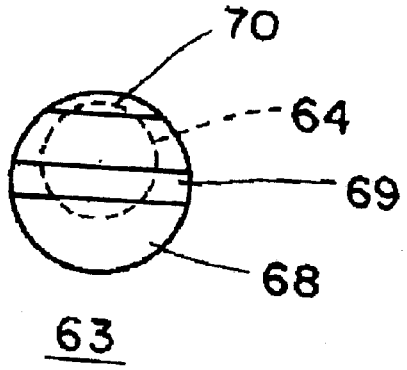
FIG. 9 is a top plan view of the eccentric cam member.
Figure 10:
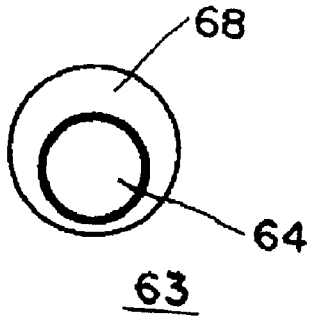
FIG. 10 is a bottom view of the eccentric cam member.

Referring to FIG. 5, the base housing 51 is insert-molded component having a metal frame 54 embedded in its insulating resin or plastic 55. Due to insert-molding, the base housing 51 can be reduced in thickness, while still retaining good strength. Likewise, the slide cover 52 is insert-molded having metal sheet 56 embedded in its insulating resin 57 in order to assist in reducing its thickness.

The metal sheet 56 of the slide cover 52 has numerous openings 58 therein in the form of grid, and the insulating resin 57 has through holes 59 made in the same grid pattern. These openings and through holes are in registration to allow the lead pins (not shown) of the pin grid-array package to pass therethrough. The base housing 51 has terminal cavities 60 formed in registration with the through holes 59 of the overlying slide cover 52. All terminal cavities 60 are loaded with terminals 61. As described later in detail, terminals 61 are press-fitted in selected terminal cavities 60 by inserting them from the upper side of the base housing 51 until their solder tails 62 appear from the bottom of the base housing 51. These solder tails or engagement sections 62 are configured for soldering on a printed circuit board. If desired, the solder tail may be modified and a solder ball attached thereto as is known in the art.

Referring to FIGS. 7 to 10, an eccentric cam 63 includes a disk-like head 68 and a round rotary axle 64 integrally connected to the disk-like head 68 but with the axis of axle 64 spaced from the axis of head 68. The eccentric cam 63 is rotatably fixed to the base housing-and-slide cover assembly by inserting the rotary axle 64 in a hole 74 which is formed on the extension at one lateral side of the base housing-and-slide cover assembly. The eccentric cam 63 is fixed to the base housing-and-slide cover assembly by applying an annular washer or fixing ring 65 to the rotary axle 64 of the eccentric cam 63 in a recess 67 in the bottom of the base housing 51, as best seen from FIG. 5. The eccentric cam functions as a slide drive as described below.

The eccentric cam 63 has a transverse slot 69 in its head 68, and the head 68 is notched as indicated by 70. (In FIGS. 1 and 5, the eccentric cam 68 has no notched portion.) When it is desired to shift slide cover 52, a screw driver is inserted into the transverse slot 69 of the eccentric cam 63 to rotate it.

The base housing 51 has an axle hole 72 made in its metal frame 54, which permits the apertured area to function as lower cam plate 71. The slide cover 52 has an upper cam plate 73 laid on the metal sheet 56, and the upper cam plate 73 has a cam hole 74 made therein. The cam hole 74 is in registration with the axle hole 72. The cam hole 74 is similar to the cam head 68 in shape (circular), and the axle hole 72 has an elliptical shape, the longer axis of which is perpendicular to the direction in which the slide cover 52 can be shifted, as seen from FIG. 11. The shorter axis of the elliptic hole generally is generally equal to the diameter of the rotary axle 64 of the eccentric cam 63. The slide cover 52 has a circular hole 75 made in the sheet metal 56. With this arrangement, rotation of the eccentric cam 63 causes the slide cover 52 to move relative to the underlying base housing 51 and the cam engages metal rather than plastic components.

The base housing 51 and the slide cover 52 are laid on each other and are operatively connected as a whole by inserting the rotary axle 64 of the eccentric cam 63 in the axle hole 72 and then securing the fixing ring 65 on the bottom of the underlying base housing 52 to the axle 64 and by inserting the lateral projections 76 of the base housing 51 in the openings 53*a* of the depending engagement pieces 53 of the overlying slide cover 52.

Figure 11:
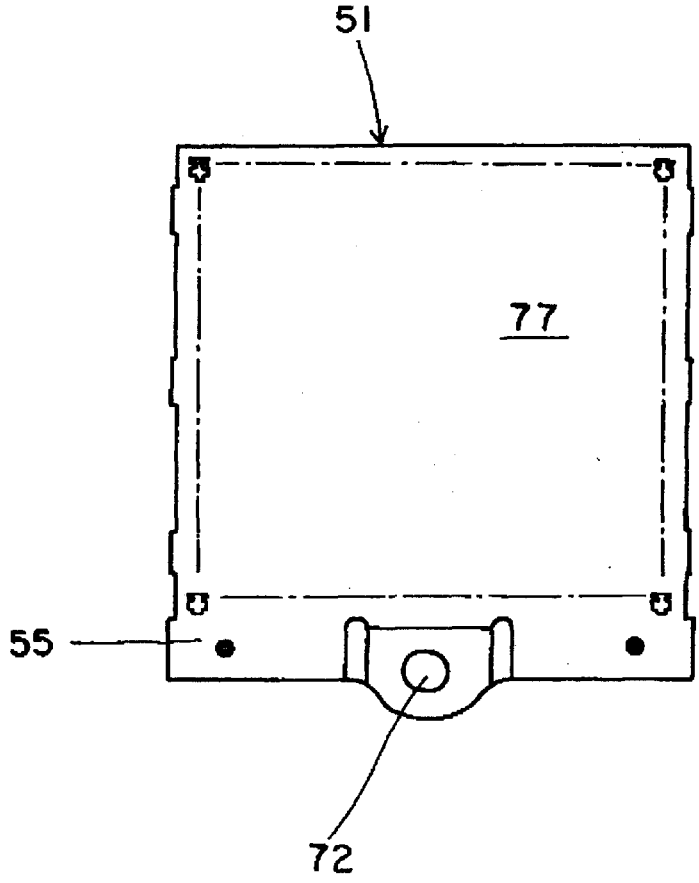
FIG. 11 is a top plan view of a base housing.
Figure 12:
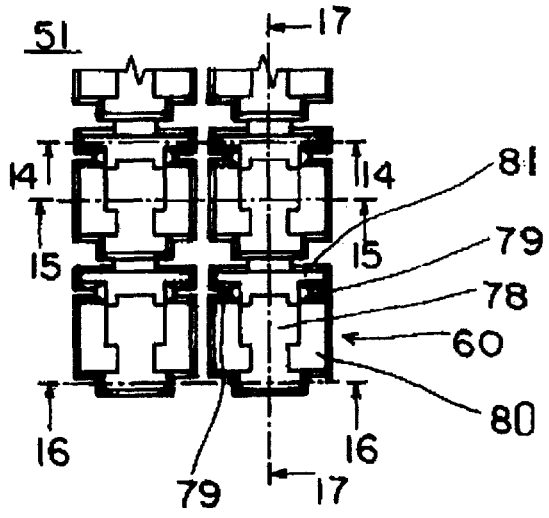
FIG. 12 is an enlarged top plan view illustrating four terminal receptacle cavities formed in the base-housing.
Figure 13:
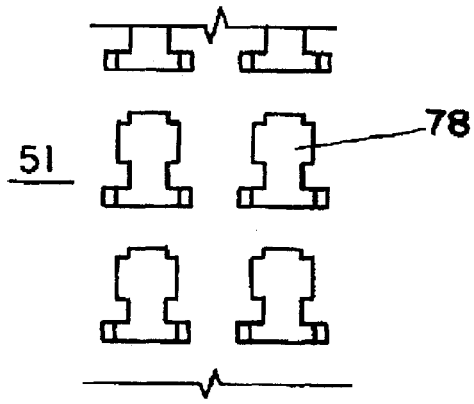
FIG. 13 is an enlarged bottom plan view of terminal receptacle cavities of FIG. 12.
Figure 14:
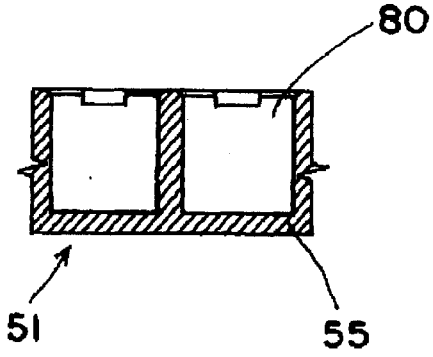
FIG. 14 is a sectional view of a fragment of the base housing taken generally along the line 14—14 in FIG. 12.
Figure 15:
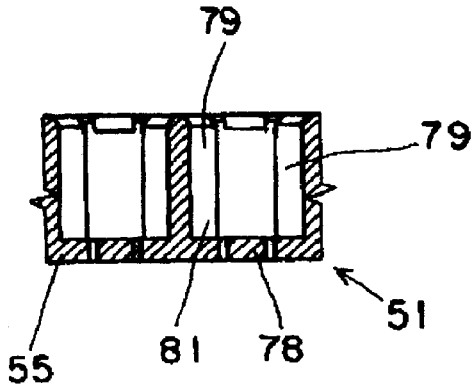
FIG. 15 is a sectional view of a fragment of the base housing taken generally along the line 15—15 in FIG. 12.
Figure 16:
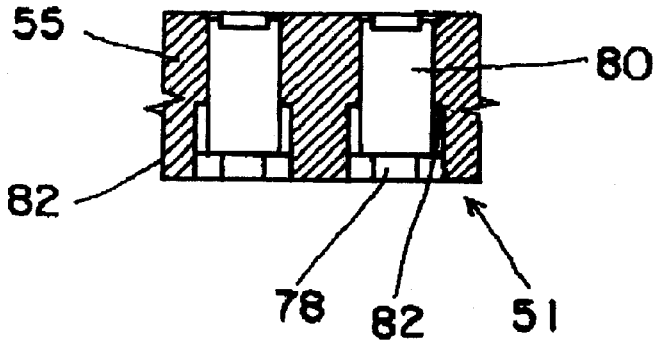
FIG. 16 is a sectional view of a fragment of the base housing taken generally along the line 16—16 in FIG. 12.
Figure 17:
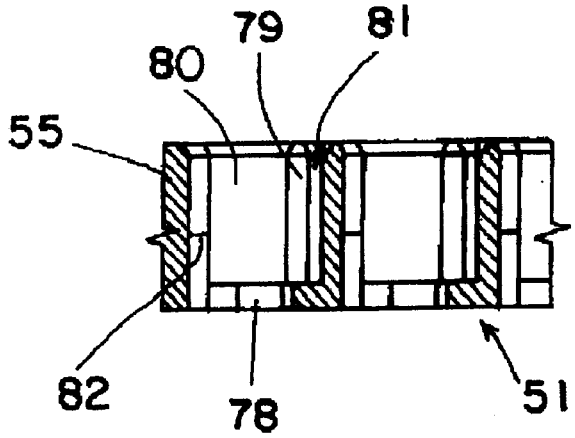
FIG. 17 is a sectional view of a fragment of the base housing taken generally along the line 17—17 in FIG. 12.
Figure 18:
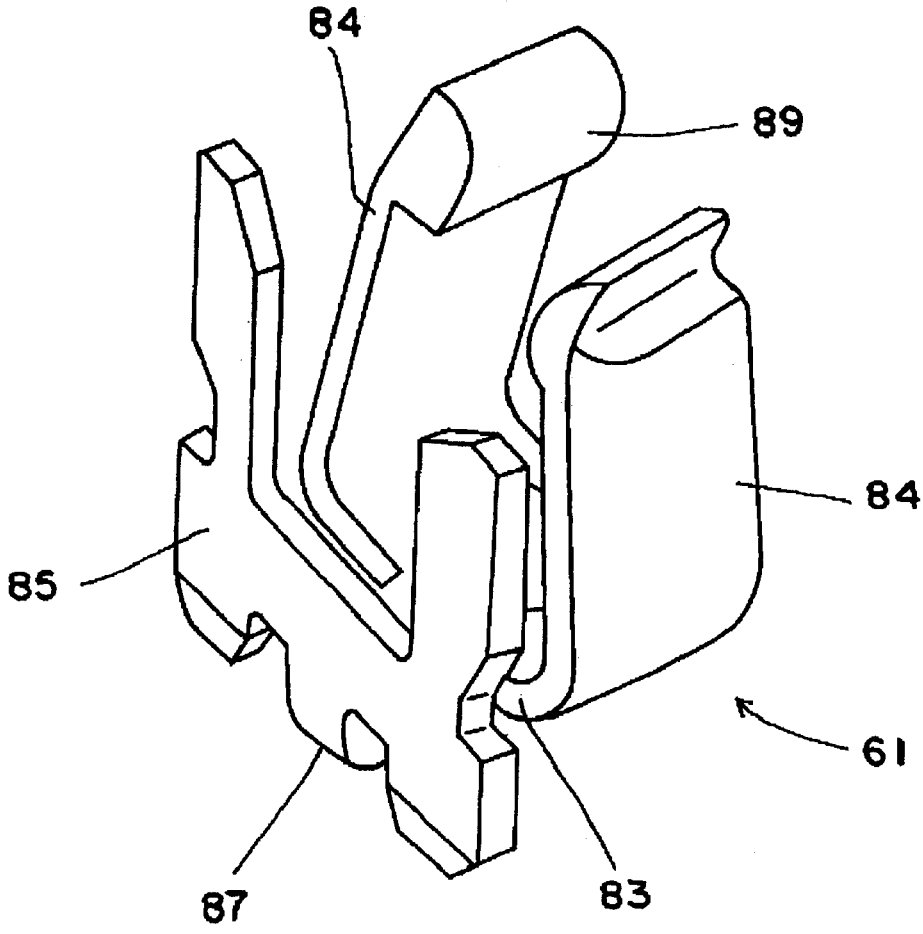
FIG. 18 is an enlarged perspective view of a terminal of the present invention.
Figure 19:
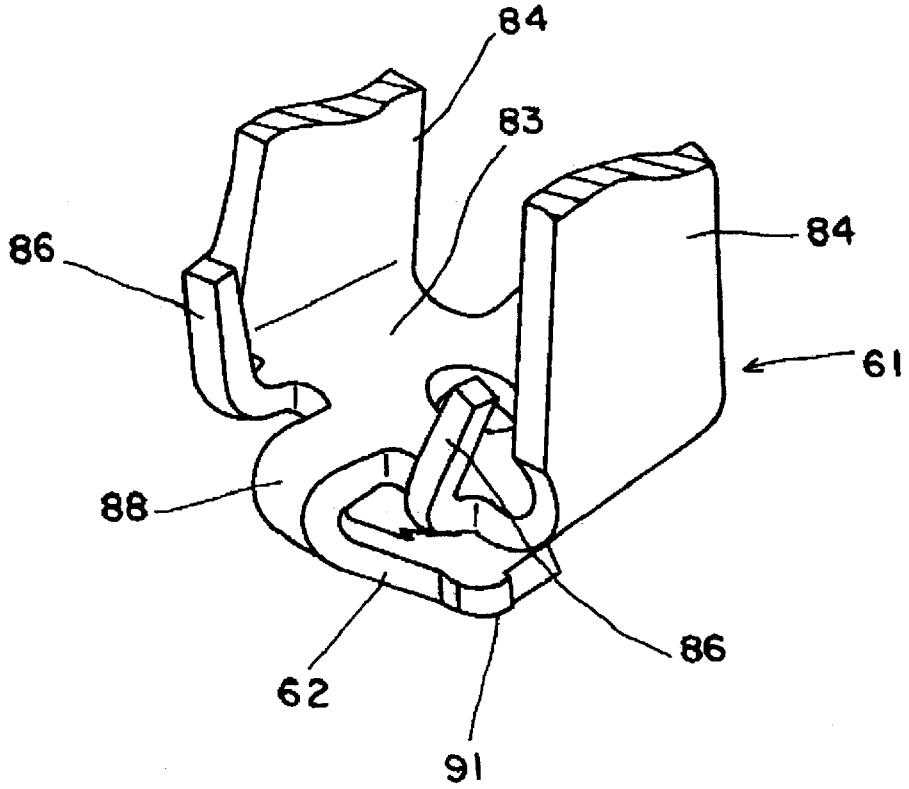
FIG. 19 is another perspective view of the terminal of FIG. 18 as viewed from the opposite side of the position from which the terminal is viewed in FIG. 18.
Figure 20:
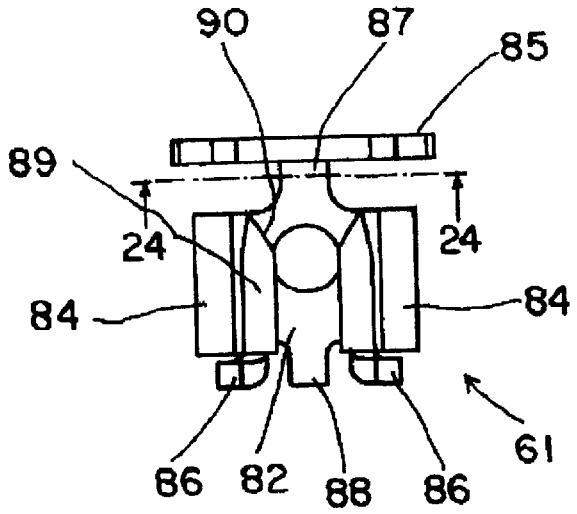
FIG. 20 is a top plan view of the terminal.
Figure 21:
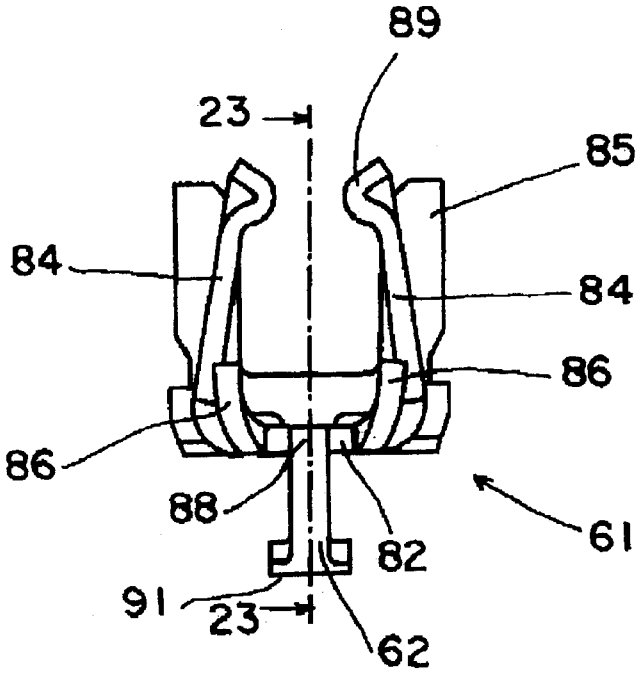
FIG. 21 is a front view of the terminal.
Figure 22:
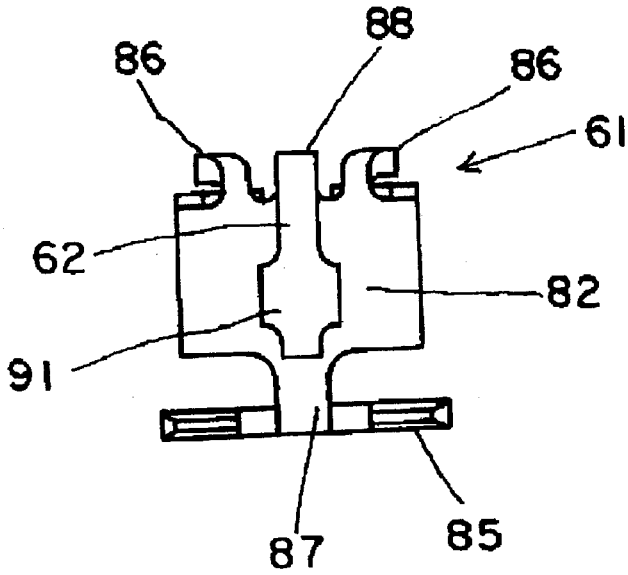
FIG. 22 is a bottom plan view of the terminal.
Figure 23:
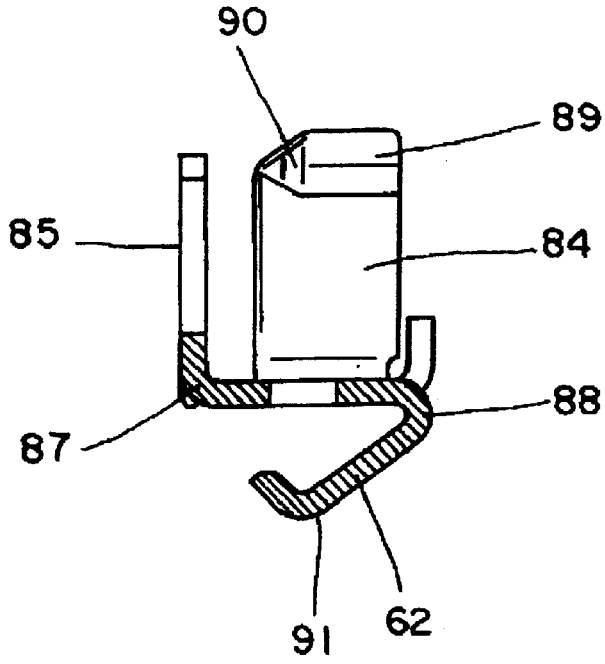
FIG. 23 is a sectional view of the terminal taken generally along the line 23—23 in FIG. 21.
Figure 24:
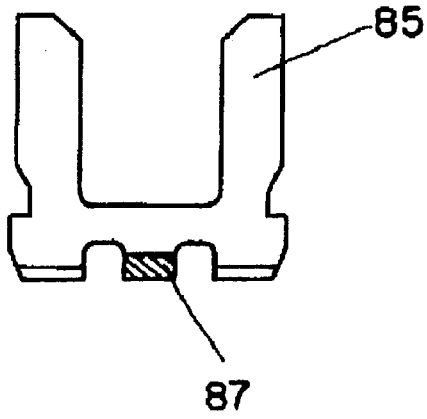
FIG. 24 is a sectional view of the terminal taken generally along the line 24—24 in FIG. 20.

As seen from FIG. 11, the terminal cavities 60 are arranged in a lattice pattern and are formed throughout base housing 51, which has the metal frame 54 embedded in the insulating resin 55. Stated otherwise, the perforated insulating resin molded component 55 is reinforced by the metal frame 54.

FIGS. 12 to 17 show some terminal cavities 60 at an enlarged scale. Each terminal cavity 60 is generally rectangular. It is open wide on the top side (see FIG. 12) of the base-housing 51, and more narrowly on the bottom side of the base housing 51 (see FIG. 13). The opening in the bottom side is large enough to allow the tail 62 of a terminal 61 to extend through the bottom of the base housing 51.

Each terminal cavity 60 has a partition wall 79 that separates contact recess 80 defined on one side, and an engagement recess 81 defined on the other side. The contact recess 80 has engagement step-like indentations 82 made in the opposite lateral walls on the side of the contact recess 80 confronting the engagement recess 81, as seen from FIGS. 16 and 17.

Referring to FIGS. 18–24, terminals 61 stamped from a thin metal sheet are shown. Specifically, the terminal 61 comprises a rectangular base 83, a solder tail 62, two detent projections 86 integrally connected to one lateral side of the rectangular base 83, two opposed contact pieces 84 integrally connected to the opposite longitudinal sides of the rectangular base 83, and a "U"-shaped engagement piece 85 integrally connected to the other lateral side of the rectangular base 83 via a first joint arm 87. The solder tail 62 is integrally connected to the one lateral side of the rectangular base 83 via a second joint arm 88, and is inclined downward below the base 83. The detent projections 86 are formed on opposite sides of the soldering tail 62 to extend upward from the one lateral side of the rectangular base 83.

The contact pieces 84 rise upright from the opposite longitudinal edges of the base 83 (see FIGS. 18 and 19) in confronting relation. Likewise, the "U"-shaped engagement piece 85 rises upright. More specifically, the opposed contact pieces 84 converge upward whereas the opposite legs of this "U"-shaped engagement piece 85 extend upright at right angles relative to the base 83 as seen from FIGS. 21 and 23. The tail 62, which is integrally connected to the one lateral side of the base 83 via the second joint arm 88, is inclined downward below the base 83 as seen from FIG. 19. The opposite detent projections 86 rise upward from the opposite sides of the second joint arm 88. The opposite detent projections diverge upward, extending somewhat obliquely relative to the horizontal base 83 as seen from FIG. 21.

The engagement recess 81 of the terminal cavity 60 has a width and length slightly smaller than the thickness (thickness of the thin metal sheet) and length of the "U"-shaped engagement piece 85, thereby permitting the engagement piece 85 to be press-fitted tightly in the engagement recess 81 of the terminal cavity 60. The engagement piece 85 is applied to the engagement recess wall of the base housing 51 over its full height.

The contact recess 80 is large enough to accommodate the opposed contact pieces 84. When the "U"-shaped engagement piece 85 is press-fitted in the engagement recess 81, the opposed contact pieces 84 are supported by the cantilever-like arm 87 of the "U"-shaped engagement piece 85 in the contact recess 80.

Each contact piece or arm 84 has a contact bead or surface 89 laterally formed on its end. The contact bead 89 is chamfered on the confronting side relative to the engagement piece 85, as indicated at 90. Thus, a divergent space is defined between the chamfered ends of the opposite contact beads 89, as seen from FIG. 20.

The solder tail 62 extends down at an acute angle from second joint arm 88 until reaching widened solder portion 91. Such widened solder portion may have generally planar edges. Widened solder portion 91 expands laterally relative to the width of solder tail 62 in order to increase the surface area of a solder joint at the widened portion 91 and to aid in vision system automated assembly. The bottom opening 78 of the terminal cavity 60 is dimensioned to be slightly larger than the widened solder portion 91.

The opposite detent projections 86 are inclined upward to catch under the step-like indentations 82 of the terminal cavity 60. When the terminal 61 is press-fit into the terminal cavity 60 from above, the opposite detent projections 86 are yieldingly bent inward to slide downward on the inner wall until they are released and caught under the step-like indentations, thereby further stabilizing the terminals 61 within the terminal cavity 60 by preventing the right hand (as seen from FIGS. 25 and 26) side of the terminals from rising up within the cavities.

When every terminal 61 is press-fit into its terminal cavity 60, the solder tail 51 appears from the bottom of the base housing 51, and the opposite edges of the "U"-shaped engagement piece 85 are caught by the inner wall of the engagement recess 81, and the opposite major faces of the "U"-shaped engagement piece 85 are pushed against the inner wall of the engagement recess 81, thus fixedly holding the terminal 61 by the engagement piece 85.

The opposed contact pieces 84 are snugly accommodated in the terminal cavity 80 while being supported by the first cantilever-like joint arm 87 extending from the "U"-shaped engagement piece 85. Stress will be caused in the terminal 61 upon insertion of a selected lead pin into the space defined between the opposite contact pieces 84 of the terminal 61. Such stress, however, will be distributed in the first and second joint arms 87 and 88, thereby reducing the stress directly on the engagement piece-to-base housing contacting area and the solder tail 62 solder joint.

Figure 1:
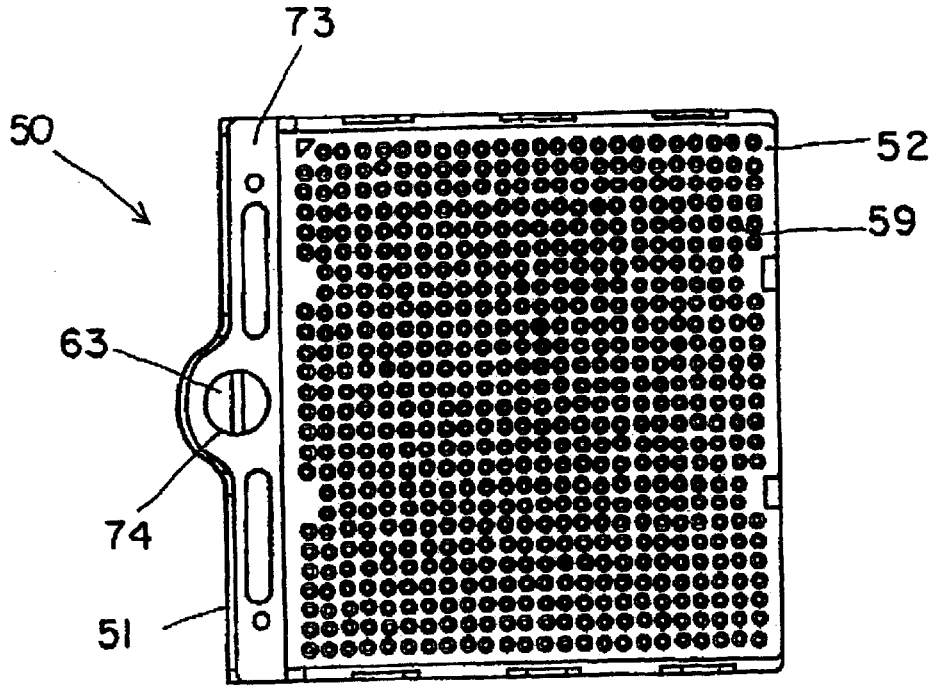
FIG. 1 is a top plan view of a socket assembly according to the present invention.
Figure 2:
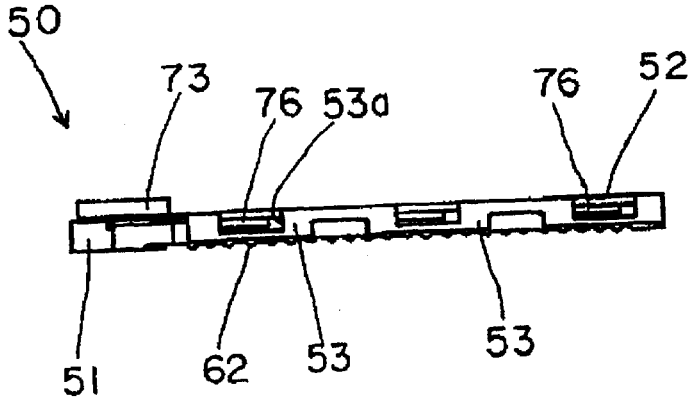
FIG. 2 is a front view of the socket assembly.
Figure 3:
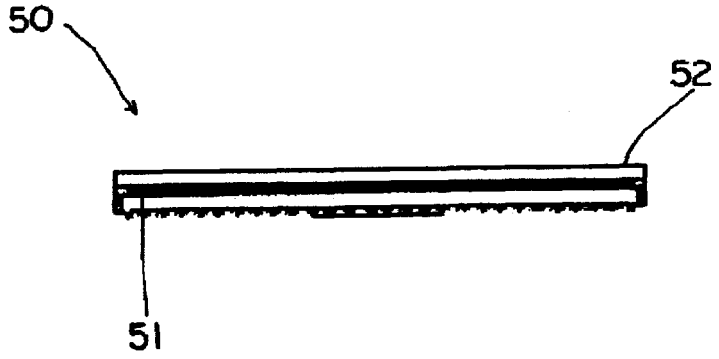
FIG. 3 is a right side view of the socket assembly.
Figure 4:
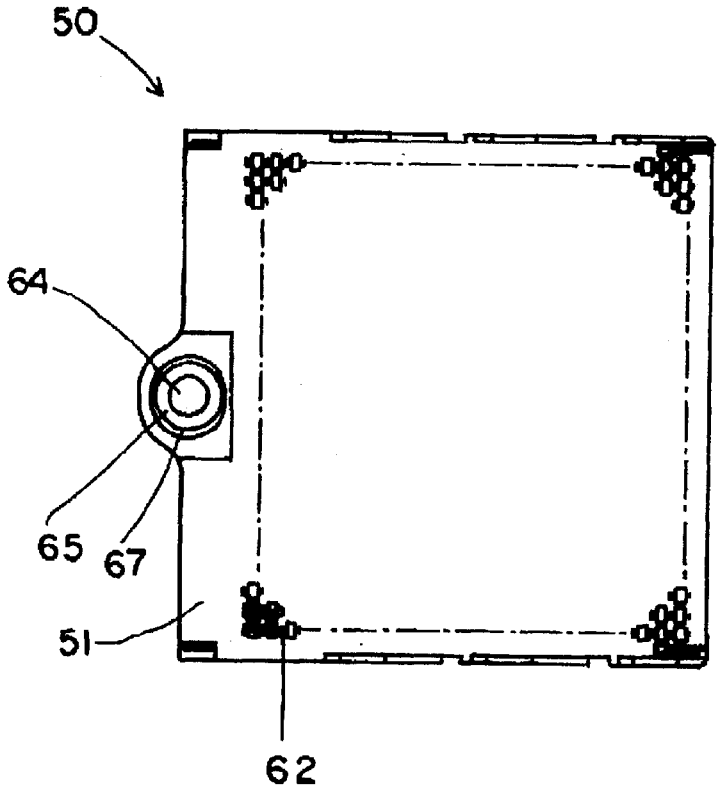
FIG. 4 is a bottom plan view of the socket assembly.

The manner of operation of socket 50 is described below. Referring to FIGS. 1 and 5, the slide cover 52 is positioned in its lead pin inserting position at which location the lead pins of the pin grid-array package can be inserted in the through holes 59 in slide cover 52 to reach the terminals mounted in the base housing 51 without the necessity of applying any force to the lead pins. In this lead pin inserting position, the through holes 59 are positioned to be in alignment with the dot-and-dash line 92 in FIG. 25. Lead pins can be inserted to abut the limited areas close to the partition walls 79, which confront the terminal cavities 60.

Figure 25:
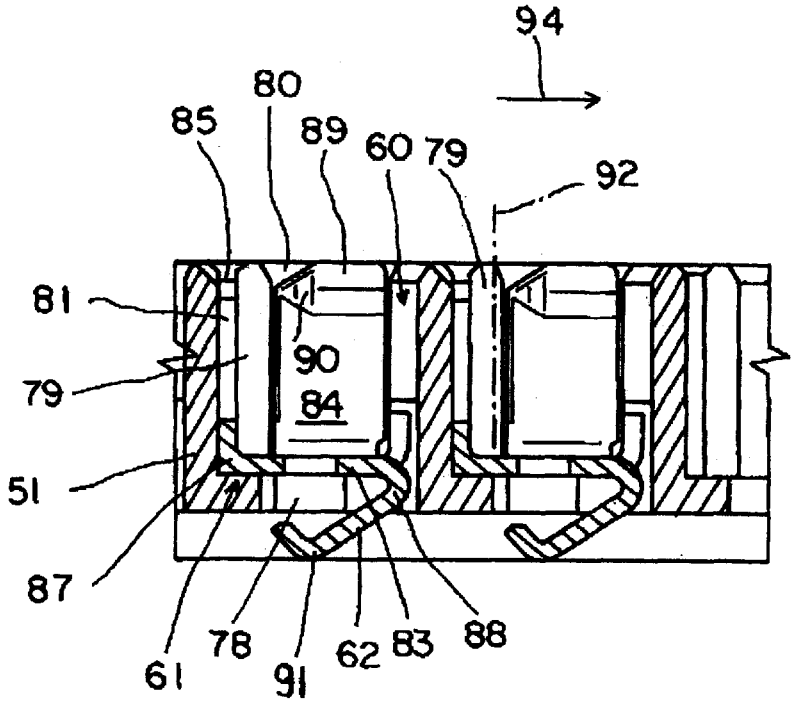
FIG. 25 is an enlarged sectional view of a fragment of the base housing similar to FIG. 17 having terminals mounted therein.
Figure 26:
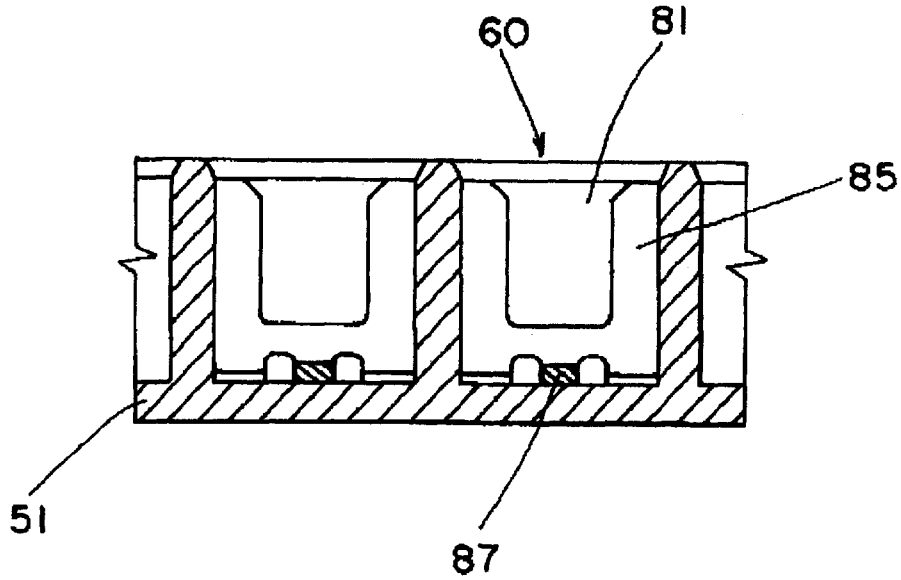
FIG. 26 is another enlarged sectional view of the fragment of the base housing having terminals mounted therein, taken along the engagement pieces of the terminals.

After inserting the lead pins in the through holes 59 of the slide cover 52, the eccentric cam 63 is rotated 90 degrees counterclockwise to move the slide cover 52 along with the lead pins as indicated by arrow 94 in FIG. 25 until the slide cover 52 is put exactly in registration with the base housing 51. In such position, each and every lead pin is positioned between the opposite contact beads 89 while engaging their confronting surfaces to make a required electric connection between the lead pin and both contact beads 89. The tapered ends of the opposite contact beads 89 assure that the lead pin smoothly enters the space between the opposite contact beads 89 and do not cause any significant stress to appear in the contact pieces 84.

As may be understood from the above, the base housing is so designed that terminals may be press-fitted in the lattice of terminal cavities from above, allowing their tails to appear from the bottom of the base housing. This contributes significantly to facilitating the assembling parts in making sockets.

The stress caused by insertion of a lead pin in a selected terminal cavity will be distributed via the first joint arm of the terminal, thus preventing direct application of undesired force to the limited engagement area between the "U"-shaped engagement piece and the surrounding wall of the base housing. The contact pieces of each terminal can be, therefore, stable in their position. Likewise, such stress will also be distributed via the second joint arm, thus preventing direct application of undesired force to the soldering area between the soldering tail and a selected conductor on a printed circuit board. Accordingly, the reliability with which the terminals of the socket are soldered to the selected conductors on a printed circuit board can be increased significantly.

What is claimed is:

1. A conductive terminal for use with an electrical connector that is mounted on a circuit member and receives a device having an array of conductive pin terminals, said terminal comprising:

a generally planar base;

a first mounting portion extending from a first edge of said base and generally perpendicular to said base for securing said terminal in a housing component of the electrical connector, a second mounting portion extending from a second edge of said base opposite said first edge and generally perpendicular to said base for securing said terminal in said housing component, an engagement section for contacting a conductive portion of said circuit member, the engagement section including a first, arcuate section extending from said base and a second, generally linear section extending from said first section generally away from said contact structure at an oblique angle relative to the plane of said base, whereby a surface mount portion of said engagement section is positioned beneath said base, and a contact structure configured for engaging a portion of a respective one of said pin terminals, the contact structure including a pair of parallel, spaced apart spring arms extending generally perpendicularly from the base.

2. The conductive terminal of claim 1 wherein said second mounting portion includes a pair of spaced apart resilient arms.

3. The conductive terminal of claim 1 wherein said pair of spaced apart spring arms of said contact structure extend from opposite edges of said base and are positioned generally between said first and second mounting portions.

4. The conductive terminal of claim 1 wherein said terminal is stamped and formed of sheet metal.

5. A conductive terminal for use with an electrical connector that is mounted on a circuit member and receives a device having an array of conductive pin terminals, said terminal comprising:

a mounting portion for securing said terminal in a housing component of said electrical connector, a contact structure configured for engaging a portion of a respective one of said pin terminals, said contact structure including a base portion extending within a horizontal plane and at least one spring arm extending upwardly from the base portion, the spring arm extending in a generally vertical first plane, and a solder tail for contacting a conductive portion of said circuit member, the solder tail extending oppositely from said one spring arm and downwardly from said base portion, said solder tail including a contact arm extending at an angle in an inclined plane and terminating in a free end, the free end including a solder section disposed beneath said base portion, the solder section having a greater width than said arm.

6. The terminal of claim 5, wherein said solder tail has generally planar edges.

7. The terminal of claim 6, wherein said contact structure includes a pair of parallel, spaced apart spring arms, extending upwardly from said base.

8. The terminal of claim 1, wherein said surface mount structure has generally planar edges.

9. A conductive terminal for use with an electrical connector that is mounted on a circuit member and receives a device having an array of conductive pin terminals, said terminal comprising:

a flat base portion having at least first, second, third and fourth edges, the first and second edges of said base portion being opposite from each other and the third and fourth edges being respectively adjacent said first and second edges of said base portion;

first and second mounting portions for securing said terminal in a housing component of the electrical connector, the first and second mounting portions respectively extending upwardly from said first and second edges of said base portion, one of said first and second mounting portions having a different height than the other of said first and second mounting portions;

a contact portion for engaging a corresponding pin of said pin terminals of said electrical connector, the contact portion including a pair of spaced-apart spring arms extending respectively upwardly from said base portion third and fourth edges; and, an engagement portion for contacting a conductive portion of said circuit member, the engagement portion including an arm that terminates in a surface mount portion, the arm extending downwardly from said base portion at an angle therefrom such that said surface mount portion is disposed beneath said base portion.

* * * * *